US009451686B2

(12) United States Patent
Choi

(10) Patent No.: US 9,451,686 B2
(45) Date of Patent: Sep. 20, 2016

(54) HYBRID PLASMA REACTOR

(71) Applicant: Dae-Kyu Choi, Gyeonggi-do (KR)

(72) Inventor: Dae-Kyu Choi, Gyeonggi-do (KR)

(73) Assignee: Dae-Kyu Choi, Gyeonggi-do (KR)

( * ) Notice: Subject to any disclaimer, the term of this patent is extended or adjusted under 35 U.S.C. 154(b) by 471 days.

(21) Appl. No.: 13/687,067

(22) Filed: Nov. 28, 2012

(65) Prior Publication Data

US 2013/0154480 A1 Jun. 20, 2013

(30) Foreign Application Priority Data

Nov. 28, 2011 (KR) ..... 10-2011-0124717

(51) Int. Cl.
*H05H 1/46* (2006.01)

(52) U.S. Cl.
CPC ..... *H05H 1/46* (2013.01); *H05H 2001/4652* (2013.01); *H05H 2001/4675* (2013.01); *H05H 2001/4682* (2013.01)

(58) Field of Classification Search
CPC ..... H01J 37/32082; H01J 37/32183; H01J 37/32091; H01J 37/321; H01J 37/3266; H01J 37/32009; H01J 37/32449; H05H 1/46; H05H 1/2406
USPC ..... 315/111.11–111.91, 248; 219/121.36–121.59
See application file for complete search history.

(56) References Cited

U.S. PATENT DOCUMENTS 5,012,125 A * 4/1991 Conway ..... H01B 9/028 174/120 SC
5,017,751 A * 5/1991 Brecher ..... H05H 1/30 219/121.48
6,020,686 A * 2/2000 Ye et al. ..... 315/111.51
6,815,633 B1 * 11/2004 Chen et al. ..... 219/121.54
6,899,054 B1 * 5/2005 Bardos ..... C23C 16/517 118/723 E
7,453,566 B2 * 11/2008 Hadidi ..... H05H 1/30 356/316
7,810,449 B2 * 10/2010 Brcka ..... H01J 37/321 118/723 I
8,866,390 B2 * 10/2014 Choi ..... H05H 1/46 315/111.01
9,035,553 B2 * 5/2015 Choi ..... H01J 37/32816 156/345.38
9,224,580 B2 * 12/2015 Smits ..... H05H 1/30
9,316,213 B2 * 4/2016 Leskosek ..... F03H 1/0018
2004/0131513 A1 * 7/2004 Lazarovich ..... B01D 53/326 422/186.04
2007/0145023 A1 * 6/2007 Holber et al. ..... 219/121.52
2013/0171038 A1 * 7/2013 Choi ..... B01J 19/12 422/186.03
2013/0307414 A1 * 11/2013 Choi ..... H01J 37/32816 315/111.51

OTHER PUBLICATIONS

Ra et al., "Etching of aluminum alloys in the transformer-coupled plasma etcher", pp. 1328-1333, Jul./Aug. 1994, J. Vac. Sci. Technol. A 12(4), Fremont, California.†

* cited by examiner
† cited by third party

*Primary Examiner* — Douglas W Owens
*Assistant Examiner* — Srinivas Sathiraju
(74) *Attorney, Agent, or Firm* — IP & T Group LLP

(57) ABSTRACT

A hybrid plasma reactor includes a reactor body having a plasma discharge space, a gas inlet, and a gas outlet; a hybrid plasma source including a first hybrid electrode and a second hybrid electrode, which face each other while the reactor body is positioned therebetween and provide a current path having one or more turns, to be inductively and capacitively coupled to plasma formed in the plasma discharge space; and an alternating switching power supply for supplying plasma generation power to the first hybrid electrode and the second hybrid electrode. The hybrid plasma reactor can complexly generate capacitively coupled plasma and inductively coupled plasma, thereby achieving a wide operation area from a low-pressure area to a high-pressure area.

12 Claims, 6 Drawing Sheets

HYBRID PLASMA REACTOR

CROSS-REFERENCE TO RELATED APPLICATION

This application claims priority of Korean patent application numbers 10-2011-0124717 filed on Nov. 28, 2011. The disclosure of each of the foregoing applications is incorporated herein by reference in its entirety.

BACKGROUND

1. Technical Field

The present invention relates to a plasma reactor for generating activated gas containing ions, free-radical, atoms, and molecules by a plasma discharge and performing a plasma processing for solid, powder, gas, etc. with the activated gas, and more particularly to a hybrid plasma reactor for complexly generating inductively coupled plasma and capacitively coupled plasma.

2. Background Art

A plasma discharge has been used for gas excitation for generating activated gas containing ions, free-radical, atoms and molecules. The activated gas is widely used in various fields, and is representatively used in various semiconductor manufacturing processes, such as etching, deposition, cleaning, and ashing.

Recently, a wafer or a Liquid Crystal Display (LCD) glass substrate for manufacturing a semiconductor device becomes larger. However, there is a need of an easily extensible plasma source having a high capability for controlling of plasma ion energy and a capability for processing a large area. It is known that remotely using the plasma is very useful in the process of manufacturing the semiconductor using plasma. For example, the remote use of the plasma has been usefully used in a cleaning of a process chamber or an ashing process for a photoresist strip. However, since a volume of the process chamber increases according to the enlargement of a substrate to be processed, a plasma source capable of remotely and sufficiently supplying high-density activated gas has been demanded.

In the meantime, a remote plasma reactor (or remote plasma generator) uses a transformer coupled plasma source or an inductively coupled plasma source. The remote plasma reactor using the transformer coupled plasma source has a structure in which a magnetic core having a first winding coil is mounted a reactor body having a toroidal structure. The remote plasma reactor using the inductively coupled plasma source has a structured in which an inductively coupled antenna is mounted in a reactor body having a hollow tube structure.

Since the remote plasma reactor having the transformer coupled plasma source is operated in a relatively high-pressure atmosphere according to a characteristic thereof, it is difficult to ignite plasma and maintain the ignited plasma in a low-pressure atmosphere. The remote plasma reactor having the inductively coupled plasma source can be operated in a relatively low-pressure atmosphere according to a characteristic thereof, but supplied power should be increased such that remote plasma reactor having the inductively coupled plasma source can be operated in a high-pressure atmosphere, so in this case, the inside of the reactor body may be damaged due to ion bombardment.

However, the remote plasma reactor efficiently operating at a low pressure or a high pressure is required according to various demands in the semiconductor manufacturing process. However, the conventional remote plasma reactor employing one of the transformer coupled plasma source and the inductively coupled plasma source failed to appropriately respond to the demands.

SUMMARY OF INVENTION

Technical Problem

Accordingly, an object of the present invention is to provide a hybrid plasma reactor capable of complexly generating inductively coupled plasma and capacitively coupled plasma so as to achieve a wide operation area from a low-pressure area to a high-pressure area.

Another object of the present invention is to provide a hybrid plasma reactor capable of complexly generating inductively coupled plasma and capacitively coupled plasma such that plasma is easily ignited and the ignited plasma is maintained in a low-pressure area and a large volume of plasma can be generated without damage of the inside of the reactor in a high-pressure area.

Solution to Problem

In order to attain the above object, one aspect according to the preferable embodiments of the present invention provides a hybrid plasma reactor including: a reactor body having a plasma discharge space, a gas inlet, and a gas outlet; a hybrid plasma source including a first hybrid electrode and a second hybrid electrode, which face each other while the reactor body is positioned therebetween and provide a current path having one or more turns, to be inductively and capacitively coupled to plasma formed in the plasma discharge space; and an alternating switching power supply for supplying plasma generation power to the first hybrid electrode and the second hybrid electrode.

Preferably, the hybrid plasma reactor further includes a magnetic core for focusing a magnetic field created by the current path having one or more turns provided by the first hybrid electrode and the second hybrid electrode.

Preferably, the reactor body has a hollow ring-shaped structure.

Preferably, the hybrid plasma reactor further includes an insulation member installed between the first hybrid electrode and the second hybrid electrode.

Preferably, the reactor body is formed of a dielectric material.

Preferably, the first hybrid electrode and the second hybrid electrode are electrically connected to each other.

Preferably, the first hybrid electrode and the second hybrid electrode are not electrically connected to each other.

Preferably, the hybrid plasma reactor further includes a switching circuit connected between the first hybrid electrode and the second hybrid electrode.

Preferably, the hybrid plasma reactor further includes an inductor or a capacitor connected between the first hybrid electrode and the second hybrid electrode.

Preferably, the hybrid plasma reactor further includes a resistance connected between the first hybrid electrode and the second hybrid electrode.

More preferably, the first hybrid electrode and the second hybrid electrode includes a cooling channel.

Still more preferably, the first hybrid electrode and the second hybrid electrode include multiple overlapped electrode plates for forming the current path having one or more turns.

Advantageous Effects of Invention

The hybrid plasma reactor according to the present invention can complexly generate capacitively coupled plasma and inductively coupled plasma, thereby achieving a wide operation area from a low-pressure area to a high-pressure area. Further, the hybrid plasma reactor according to the present invention can easily ignite plasma and maintain the ignited plasma in a low-pressure area and generate a large volume of plasma without damage of the inside of the reactor in a high-pressure area. Accordingly, the hybrid plasma reactor according to the present invention can appropriately respond to a process performed in a process chamber regardless of a change of a characteristic of various process conditions progressed in the process chamber.

BRIEF DESCRIPTION OF DRAWINGS

The above and other aspects, features and advantages of the present invention will be more apparent from the following detailed description taken in conjunction with the accompanying drawings, in which.

DESCRIPTION OF EMBODIMENTS

Figure 1:
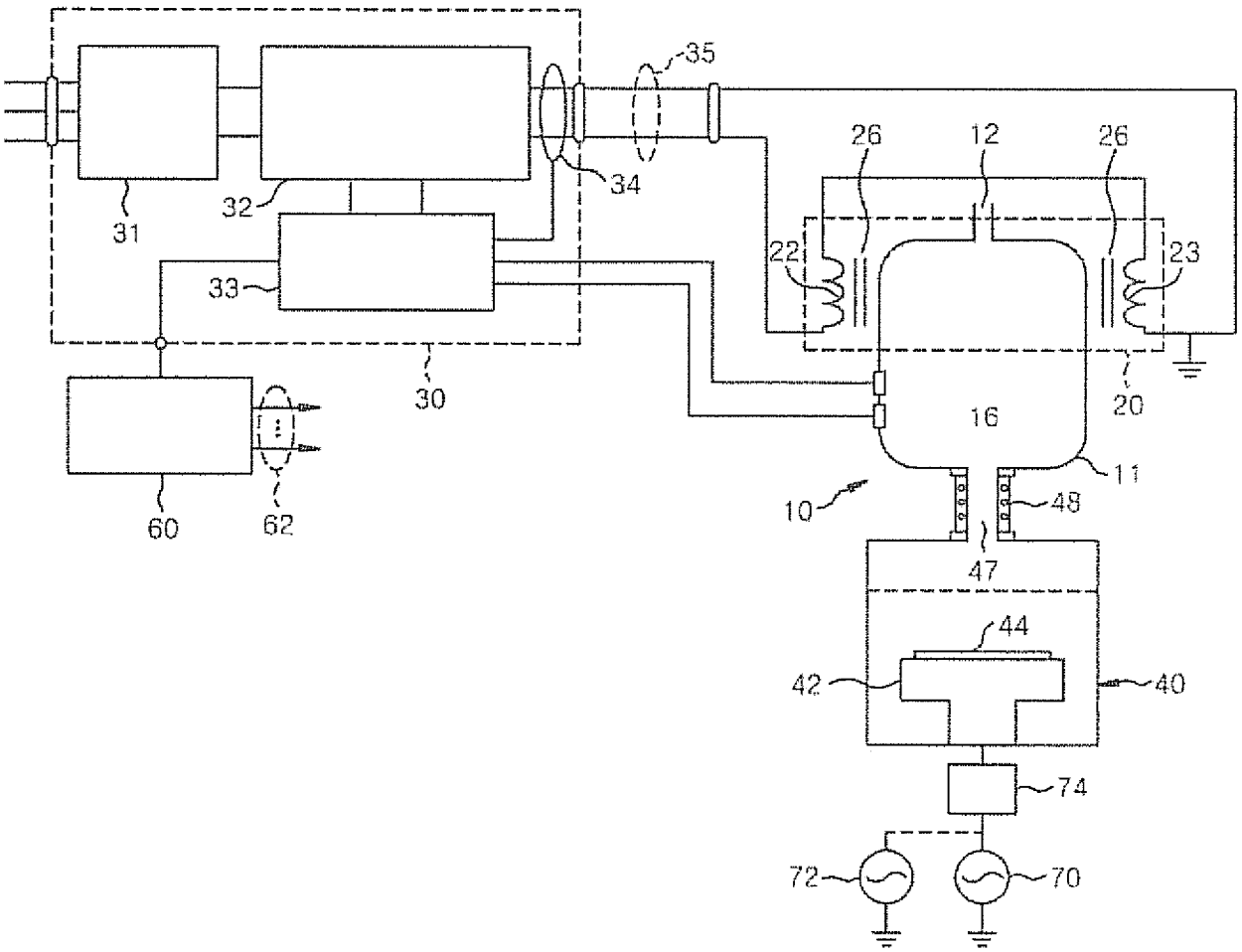
FIG. 1 is a block diagram illustrating a general construction of a hybrid plasma reactor and a plasma processing system including the hybrid plasma reactor according to the present invention.

Hereinafter, an exemplary embodiment of the present invention will be described in detail with reference to the accompanying drawings for the full understanding of the present invention. The embodiment of the present invention will be modified into various forms and it shall not be construed that the scope of the present invention is limited to the embodiment to be described below. The embodiment of the present invention is provided to more fully explain the present invention to a skilled person in the art. Accordingly, a shape, or the like of an element in the drawing may be exaggerated for more accurate description. Like reference numerals indicate like elements throughout the specification and drawings. In the following description, detailed explanation of known related functions and constitutions may be omitted to avoid unnecessarily obscuring the subject manner of the present invention.

FIG. 1 is a block diagram illustrating a general construction of a hybrid plasma reactor and a plasma processing system including the hybrid plasma reactor according to the present invention.

Referring to FIG. 1, a hybrid plasma reactor 10 (hereinafter, simply referred to as a plasma reactor) of the present invention is installed in an outside of a process chamber 40 and remotely supplies plasma to the process chamber 40. The plasma reactor 10 includes a hybrid plasma source 20. The hybrid plasma source 20 include a first hybrid electrode 22 and a second hybrid electrode 23 inductively and capacitively coupled to the plasma generated in the plasma reactor 10. The plasma reactor 10 complexly generates the inductively coupled plasma and the capacitively coupled plasma by the hybrid plasma source 20, so that it is possible to stably generate the plasma under a wide range of a pressure condition from a low pressure of 1 torr or lower to a high pressure of 10 torr or higher. The plasma reactor 10 includes a reactor body 11 for providing a plasma discharge space. The reactor body 11 has a gas inlet 12 and a vas outlet 16. The gas outlet 16 is connected to a chamber gas inlet 47 of the process chamber through an adapter 48. The plasma vas generated in the plasma reactor 10 is supplied to the process chamber 40 through the adapter 48.

The first hybrid electrode 22 and the second hybrid electrode 23 included in the plasma reactor 10 face each other while the reactor body 11 is disposed therebetween, and provide a current path having one or more turns to be inductively and capacitively coupled to the plasma formed in the plasma discharge space inside the reactor body 11. Further, a magnetic core 26 may be installed in order to increase a focus efficiency of a magnetic field induced by the current path having one or more turns formed by the first hybrid electrode 22 and the second hybrid electrode 23. That is, the first hybrid electrode 22 and the second hybrid electrode 23 have a structure in which a function serving as an electrode for the capacitive coupling is combined with a function serving as an antenna coil for the inductive coupling.

The process chamber 40 includes a substrate supporter 42 for supporting a substrate 44 to be processed in the inside thereof. The substrate supporter 42 is electrically connected to one or more bias power supplies 70 and 72 through an impedance matching device 74. The adapter 48 may include an insulation section for electrical insulation and a cooling channel for preventing overheating. The process chamber 40 includes a baffle 46 for distributing plasma gas between the substrate supporter 42 and the chamber gas inlet 47 in the inside thereof. The baffle 46 allows the plasma gas introduced through the chamber gas inlet 47 evenly distributed and diffused to the substrate to be processed. For example, the substrate 44 to be processed is a silicon water substrate for manufacturing a semiconductor device or a glass substrate for manufacturing an LCD or a plasma display.

The hybrid plasma source 20 is operated through receiving a wireless frequency from a power supply 30. The power supply 30 includes one or more switching semiconductor devices, and an AC switching power supply 32 for generating a wireless frequency, a power control circuit 33, and a voltage supply 31. For example, the one or more switching semiconductor devices include one or more switching transistors. The voltage supply 31 converts an alternating voltage input from the outside to a constant voltage and supplies the converted voltage to the AC switching power supply 32. The AC switching power supply 32 is operated according to the control of the power control circuit 33 and generates the wireless frequency.

The power control circuit 33 controls an operation of the AC switching power supply 32 to control the voltage and the current of the wireless frequency. The control of the control circuit 33 is performed based on an electrical or optical parameter value connected to at least one of the hybrid plasma source 20 and the hybrid plasma generated in the inside of the reactor body 11. To this end, the power control circuit 33 includes a measurement circuit for measuring the electrical or optical parameter value. For example, the measurement circuit for measuring the electrical and optical parameter of the plasma includes a current probe and an optical detector. The measurement circuit for measuring the electrical parameter of the plasma source 20 measures a driving current, a driving voltage, an average power, and a maximum power of the hybrid plasma source 20 and a voltage generated in the voltage supply 31.

The power control circuit 33 continuously monitors the related electrical or optical parameter value through the measurement circuit, compares the measured value and a reference value based on a normal operation, controls the AC switching power supply 32, and controls the voltage and the current of the wireless frequency. Although it is not specifically illustrated, the power supply 30 includes a protection circuit for preventing an electrical damage which may be generated due to an abnormal operation environment. The power supply 30 is connected to a system controller 60 for generally controlling the plasma processing system. The power supply 30 provides the system controller 60 with operation state information on the plasma reactor 10. The system controller 60 generates a control signal for generally controlling the operation of the plasma processing system and controls the operation of the.

The plasma reactor 10 and the power supply 30 have a physically separated structure. That is, the plasma reactor 10 is electrically connected to the power supply 30 by a wireless frequency supply cable 35. The separation structure of the plasma reactor 10 and the power supply 30 provides easy repair and maintenance and easy installation. However, the plasma reactor 10 may be integrally formed with the power supply 30.

The hybrid plasma reactor 10 of the present invention is initially ignited by a function of the first hybrid electrode 22 and the second hybrid electrode 23 serving as the capacitively coupled electrode. Accordingly, the plasma reactor 10 may not include a separate ignition circuit. Since the plasma reactor 10 does not include a separate ignition circuit, a construction of the circuit becomes simple. Further, it is advantageously possible to reduce pollution generated in an ignition process when a conventional ignition circuit is included in the inside of the reactor body 11.

The hybrid plasma reactor 100 has a structure capable of generating the capacitively coupled plasma and the inductively coupled plasma, so that it maintains the plasma ignition in a lower pressure condition of 1 torr or lower and a high pressure condition of 10 torr or higher. While the plasma reactor using only the transformer coupled plasma source is difficult to maintain the plasma ignition in the lower pressure condition, the plasma reactor 10 of the present invention can maintain the plasma ignition both in the low pressure condition and the high pressure condition, so it is characterized in that the plasma reactor 10 can be operated in a wide pressure condition.

Such an operative characteristic may be usefully used in relation to a process progressed in the process chamber 40. For example, the pressure condition of the plasma reactor 10 may be changed depending on various process characteristics, such as a substrate processing process and a cleaning process progressed by the process chamber 40. In this case, the plasma reactor 10 may appropriately respond to the process processed in the process chamber 40 regardless of the change of the pressure condition.

Figure 2:
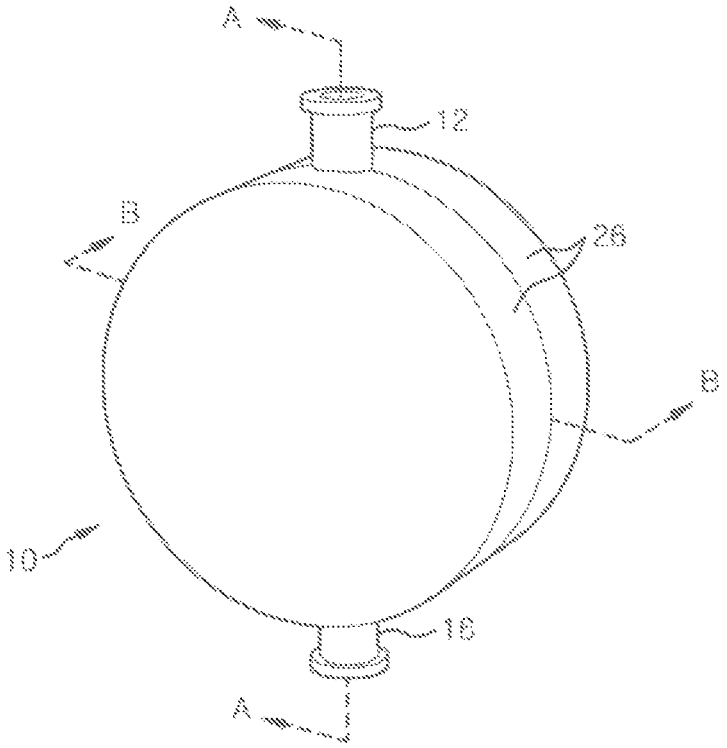
FIG. 2 is a perspective view illustrating a hybrid plasma reactor according to the present invention.
Figure 3:
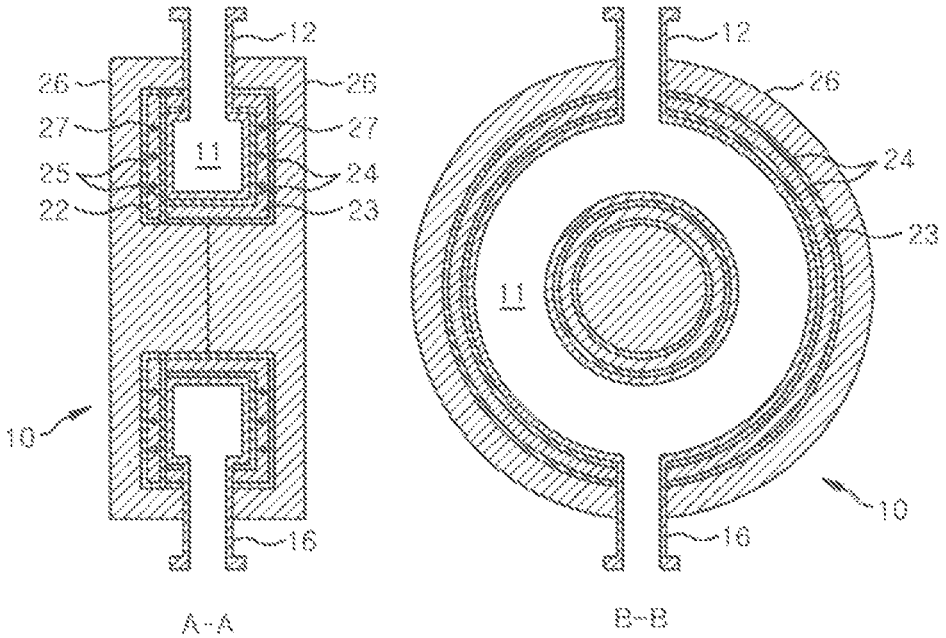
FIG. 3 is a cross-sectional view illustrating a hybrid plasma reactor taken along lines A-A and B-B of FIG. 2.
Figure 4:
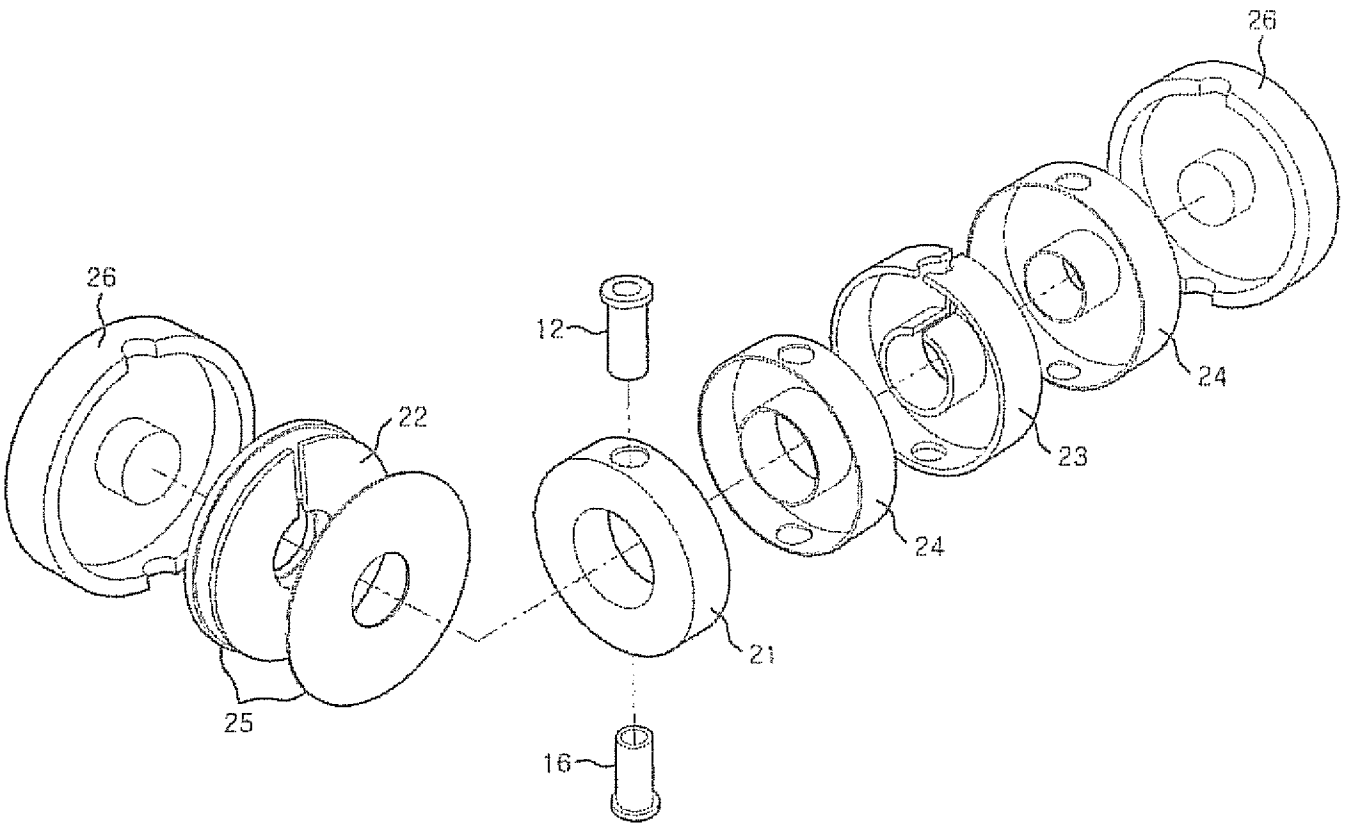
FIG. 4 is an exploded perspective view illustrating a hybrid plasma reactor according to the present invention.

FIG. 2 is a perspective view illustrating the hybrid plasma reactor according to the present invention, FIG. 3 is a cross-sectional view illustrating the hybrid plasma reactor taken along lines A-A and B-B of FIG. 2, and FIG. 4 is an exploded perspective view illustrating the hybrid plasma reactor according to the present invention.

Referring to FIGS. 2 to 4, the hybrid plasma reactor 10 according to the embodiment of the present invention includes the reactor body 11 including the plasma discharge space, the gas inlet, and the gas outlet 16. The reactor body is shaped like a hollow ring, and includes the gas inlet 12 in an upper part thereof and the gas outlet 16 in a lower part thereof. The first hybrid electrode 22 and the second hybrid electrode 23 face each other while the reactor body 11 is positioned therebetween. The first hybrid electrode 22 and the second hybrid electrode 23 are surrounded by separate insulation covers 24 and 25, respectively. The insulation covers 24 and 25 serve as insulation members between the first hybrid electrode 22 and the second hybrid electrode 23. The first hybrid electrode 22 and the second hybrid electrode 23 are structuralized so as to provide the current path having one or more turns. For example, the first hybrid electrode 22 has a disk-shaped donut structure in which a predetermined section is cut. The second hybrid electrode 23 has a disk-shaped donut structure in which a predetermined section is cut, likewise to the first hybrid electrode 22, but is structuralized such that it partially surrounds the reactor body 11. The magnetic core 26 has a cover structure and is mounted such that it entirely surrounds an outside part of the reactor body 11 so as to focus the magnetic field formed by the current path provided by the first hybrid electrode 22 and the second hybrid electrode 23.

The reactor body 11 may be formed of a dielectric material, such as quartz, or an appropriate alternative material. The first hybrid electrode 22 and the second hybrid electrode 23 include a cooling channel 27 for preventing overheating in the inside thereof. Otherwise, a separated cooling cover covering the reactor body 11 may be included or a separate cooling channel may be formed in an appropriate part of the plasma reactor 10. The reactor body 11 includes the gas inlet 12 in the upper part thereof and the was outlet 16 in the lower part thereof. The gas outlet 16 is connected to the process chamber 40 through the adapter 48. The gas introduced through the gas inlet 12 flows along the ring-shaped path formed by the reactor body 11 and is exhausted to the process chamber 40 through the gas outlet 16 formed in the lower part of the reactor body 11.

FIGS. 5 to 8 are views illustrating an electrical connection structure and operation of the hybrid electrodes.

Figure 5:
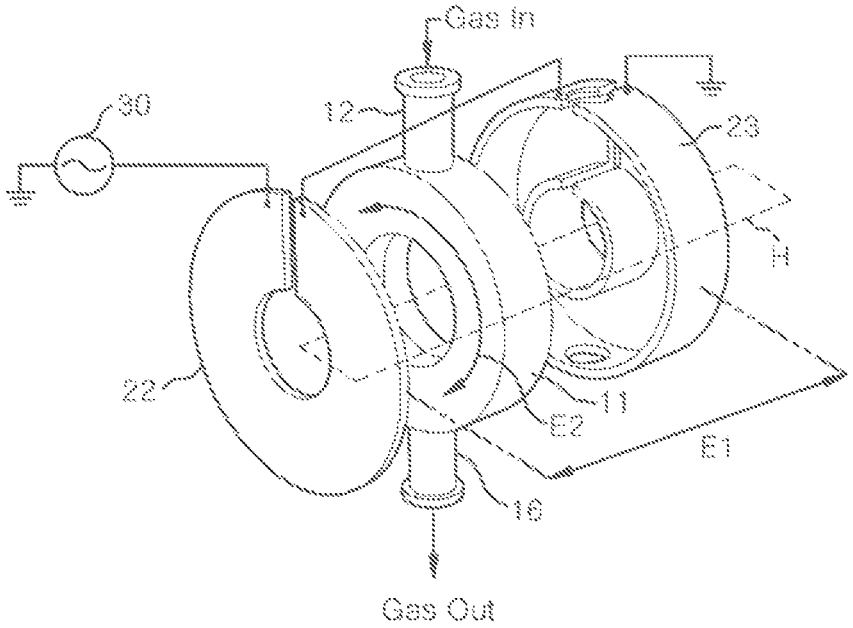
FIGS. 5 to 8 are views illustrating an electrical connection structure and operation of a hybrid electrode.

Referring to FIG. 5, one end of the first hybrid electrode 22 is connected to the power supply 30 and an opposite end of the first hybrid electrode 22 is connected to one end of the second hybrid electrode 23. An opposite end of the second hybrid electrode 23 is ground connected. Accordingly, a winding structure having two turns is formed by the first hybrid electrode 22 and the second hybrid electrode 23. In this case, a first electric field E1 serves as the plasma discharge space of the reactor body 11 by a potential difference generated between the first hybrid electrode 22 and the second hybrid electrode 23. Further, a magnetic field H formed by the two turns of current path provided by the first hybrid electrode 22 and the second hybrid electrode 23 create a second electric field E2 in a ring-shaped plasma discharge space provided by the reactor body 11. Accordingly, the capacitively coupled plasma and the inductively coupled plasma are complexly formed in the plasma discharge space within the reactor body 11.

Figure 6:
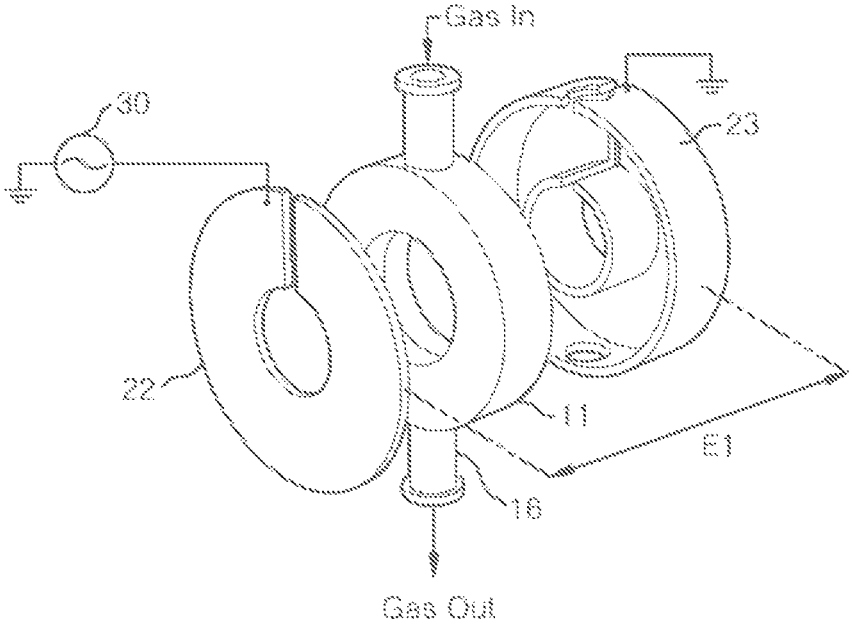
Figure 7:
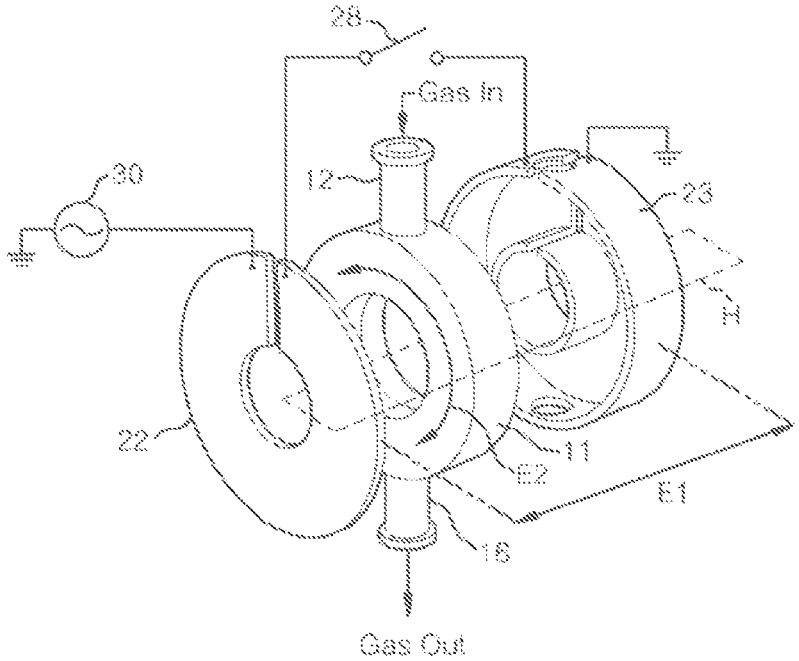
Figure 8:
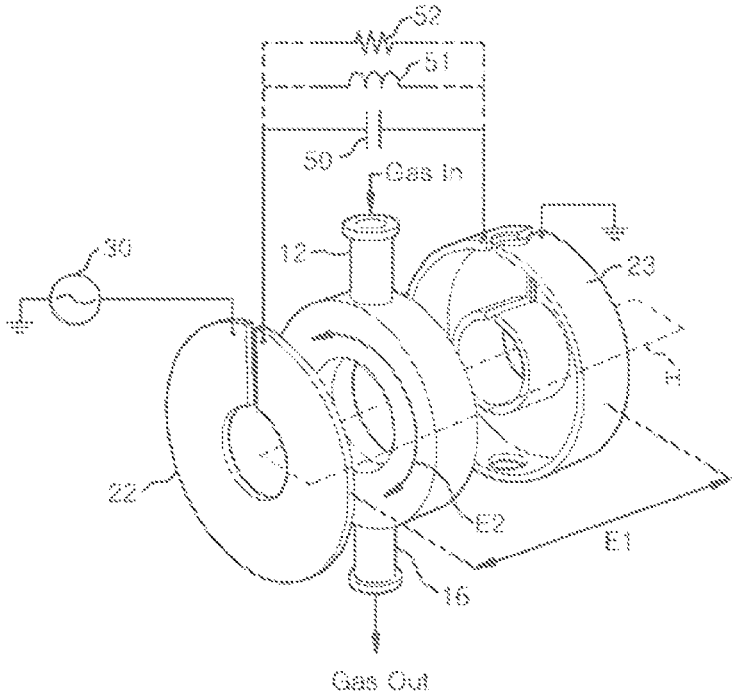

However, as illustrated in FIG. 6, the first hybrid electrode 22 and the second hybrid electrode 23 may not be electrically connected as described above with reference to FIG. 5. In this case, the first hybrid electrode 22 and the second hybrid electrode 23 may only serve as the capacitively coupled electrodes. As illustrated in FIG. 7, a switching circuit 28 may be formed between the first hybrid electrode 22 and the second hybrid electrode 23 such that the first hybrid electrode 22 and the second hybrid electrode 23 can serves as only the capacitively coupled electrodes or as hybrid electrodes. Additionally, as illustrated in FIG. 8, an additional circuit, such as a capacitor 50, an inductor 51, or a resistance 52 may be formed between the first hybrid electrode 22 and the second hybrid electrode 23. At least one circuit may be selected in order to improve an entire operational efficiency of the plasma reactor 10.

Figure 9:
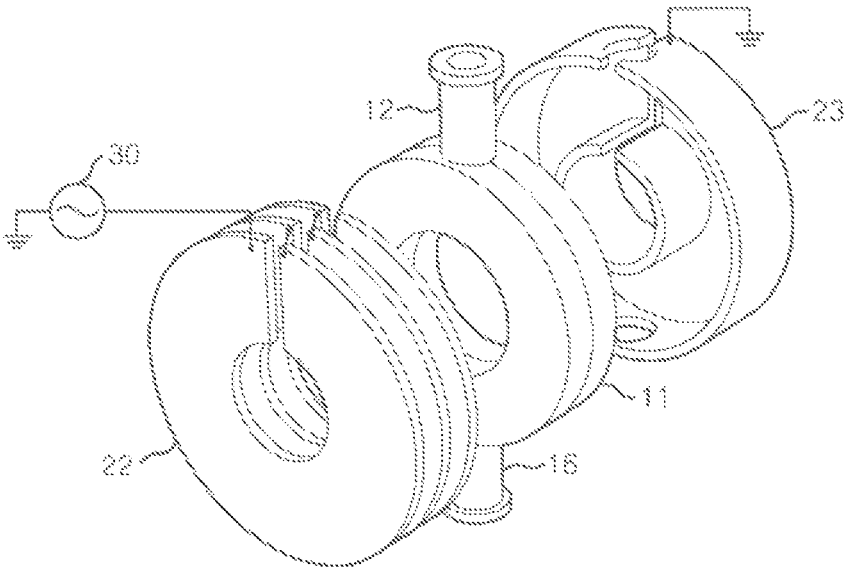
FIGS. 9 and 10 are views illustrating modifications of a hybrid electrode.
Figure 10:
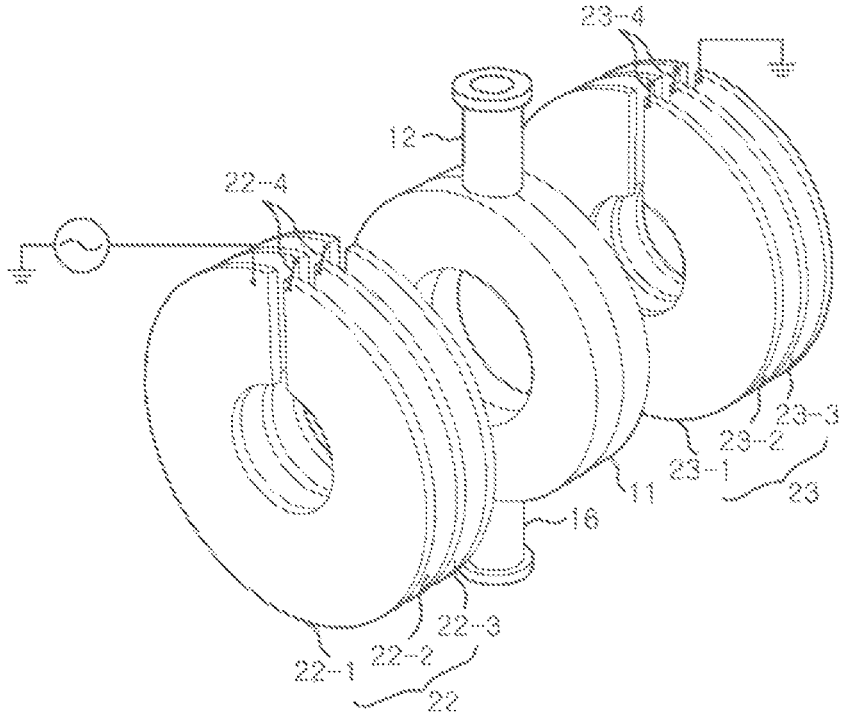

FIGS. 9 and 10 are views illustrating modifications of the hybrid electrodes. Referring to FIGS. 9 and 10, the first hybrid electrode 22 and the second hybrid electrode 23 includes multiple overlapped electrode plates 22-1 to 22-3 and 23-1 to 23-3 so as to form the current path having at least one turn. When the multiple overlapped electrode plates 22-1 to 22-3 and 23-1 to 23-3 are used, it is preferable that an appropriate insulation member is inserted to each space between the multiple overlapped electrode plates 22-1 to 22-3 and 23-1 to 23-3. Each of the multiple overlapped electrode plates 22-1 to 22-3 and 23-1 to 23-3 is electrically connected to each other so as to provide a rotating current path.

The foregoing is merely an exemplary embodiment of the hybrid plasma reactor according to the present invention, and it will be readily understood by those skilled in the art that various modifications and changes can be made thereto within the technical spirit and scope of the present invention, and the scope of the present invention shall not be limited to the described embodiment. Accordingly, the technical protective scope of the present invention shall be defined by the technical spirits of the accompanied claims. Further, those skilled in the art will appreciate that the present invention includes all modifications, equivalents, and substitutes with in the scope of the spirit of the present invention defined by the accompanied claims.

What is claimed is:

1. A hybrid plasma reactor comprising:

a reactor body having a plasma discharge space, a gas inlet, and a gas outlet;

a hybrid plasma source including a first hybrid electrode having a disk-shaped donut structure and a second hybrid electrode having a disk-shaped donut structure with a section cut to align with and receive the first hybrid electrode, so that the first and second hybrid electrodes partially surround the reactor body positioned therebetween when aligned and assembled to each other, and provide a current path having one or more turns, to be inductively and capacitively coupled to plasma formed in the plasma discharge space; and an alternating switching power supply for supplying plasma generation power to the first hybrid electrode and the second hybrid electrode, wherein a capacitively coupled plasma is formed in the plasma discharge space when the first and second hybrid electrodes function as the capacitive coupling electrodes, and wherein an inductively coupled plasma is formed when the first and second hybrid electrodes create a current path having at least one turn due to a disconnected interval in the plasma discharge space, complexly generating inductively coupled plasma and capacitively coupled plasma.

2. The hybrid plasma reactor according to claim 1, further comprising a magnetic core for focusing a magnetic field created by the current path having one or more turns provided by the first hybrid electrode and the second hybrid electrode.

3. The hybrid plasma reactor according to claim 1, wherein the reactor body has a hollow ring-shaped structure.

4. The hybrid plasma reactor according to claim 1, further comprising an insulation member installed between the first hybrid electrode and the second hybrid electrode.

5. The hybrid plasma reactor according to claim 1, wherein the reactor body is formed of a dielectric material.

6. The hybrid plasma reactor according to claim 1, wherein the first hybrid electrode and the second hybrid electrode are electrically connected to each other.

7. The hybrid plasma reactor according to claim 1, wherein the first hybrid electrode and the second hybrid electrode are not electrically connected to each other.

8. The hybrid plasma reactor according to claim 1, further comprising a switching circuit connected between the first hybrid electrode and the second hybrid electrode.

9. The hybrid plasma reactor according to claim 1, further comprising an inductor or a capacitor connected between the first hybrid electrode and the second hybrid electrode.

10. The hybrid plasma reactor according to claim 1, further comprising a resistance connected between the first hybrid electrode and the second hybrid electrode.

11. The hybrid plasma reactor according to claim 1, wherein the first hybrid electrode and the second hybrid electrode comprises a cooling channel.

12. The hybrid plasma reactor according to claim 1, wherein the first hybrid electrode and the second hybrid electrode comprise multiple overlapped electrode plates for forming the current path having one or more turns.

* * * * *